US006793076B1

(12) United States Patent
Luo et al.

(10) Patent No.: US 6,793,076 B1
(45) Date of Patent: Sep. 21, 2004

(54) GLASS BOTTLE PROTECTIVE ENCLOSURE

(75) Inventors: Mary Ziping Luo, South El Monte, CA (US); Jack Yongfeng Zhang, South El Monte, CA (US); Frank Z. Xia, South El Monte, CA (US); Rong Zhou, South El Monte, CA (US); Denny R. S. Ko, South El Monte, CA (US)

(73) Assignee: Amphastar Pharmaceuticals, Inc., Rancho Cucamonga, CA (US)

( * ) Notice: Subject to any disclaimer, the term of this patent is extended or adjusted under 35 U.S.C. 154(b) by 224 days.

(21) Appl. No.: 10/090,033

(22) Filed: Mar. 5, 2002

(51) Int. Cl.[7] ..... B65D 81/02
(52) U.S. Cl. ..... 206/521; 206/592; 215/12.1
(58) Field of Search ..... 206/521, 591, 206/592, 594, 438; 215/12.1; 220/737, 739, 740

(56) References Cited

U.S. PATENT DOCUMENTS 2,480,247 A * 8/1949 Jamison et al. ..... 215/11.6
3,968,871 A * 7/1976 Briscoe ..... 206/1.5
4,098,577 A * 7/1978 Halpern ..... 436/1
4,114,759 A * 9/1978 Maloney, Jr. ..... 206/523
4,300,612 A * 11/1981 Schroeder et al. ..... 206/521
4,813,541 A * 3/1989 Velasco et al. ..... 206/459.1
5,186,344 A * 2/1993 Cook ..... 215/330
5,695,090 A * 12/1997 Burdick ..... 220/739
5,860,550 A * 1/1999 Miller et al. ..... 220/4.23
6,112,579 A * 9/2000 Tryba ..... 73/40.5 R

FOREIGN PATENT DOCUMENTS

GB 2240332 A * 7/1991 ..... B65D/45/02

* cited by examiner

*Primary Examiner*—Jila M. Mohandesi
(74) *Attorney, Agent, or Firm*—Albert O. Cota

(57) ABSTRACT

A glass bottle protective enclosure (10) designed to protect a glass bottle (100) in the event the bottle is subjected to an impact shock. The enclosure is provided with a leak-proof seal and is particularly adapted for protecting glass bottles (100) containing toxic injectable medication. The enclosure (10), which is preferably made from a transparent plastic, consists of a lower bottle container (12) which includes a base (14) and a plurality of shock absorbing protrusions (30), which are located to allow a bottle label to be clearly visible, on the base (14) is located at least one sensor cavity (120) into which is inserted an enclosure leakage sensor (122) consisting of either a water soluble sensor (124) or an electronic sensor (126). Both of which provide an indication if a bottle leakage occurs. To complete the enclosure (10) the container (12) includes a threaded bottle container cap (36) which includes a plurality of cap shock absorbing protrusions (52).

22 Claims, 3 Drawing Sheets

GLASS BOTTLE PROTECTIVE ENCLOSURE

TECHNICAL FIELD

The invention pertains to the general field of glass bottle shock-protective structures and more particularly to a glass bottle protective enclosure which specifically protects glass bottles containing toxic injectable medication.

BACKGROUND ART

One of the most effective means of storing and transporting substances, especially fluids, is the use of glass containers or bottles. In recent times, though, plastic has become the preferred material for many products that, in the past, were exclusively manufactured from glass, such as bottles. The reasons for the replacement of glass by plastic are primarily that plastic weighs less and is less expensive and easier to produce. Along with the additional safety factors, such as less chance of breakage, it is no surprise that plastic has almost completely replaced glass containers.

One of the main industries that still relies upon glass for bottles is the medical industry. While plastic bottles have replaced glass bottles in some applications, there is still a need or requirement for glass. This is particularly true for the storage and transportation of certain drugs/medicines, such as those that are toxic or susceptible to contamination.

A major problem exists in that plastic bottles have been shown to allow/cause contamination of the contents therein. Plastic bottles also allow certain (usually organic compounds) medications to be absorbed into the plastic surface of the bottle, which reduces the potency of the medication and causes difficulty in administering sufficient amounts. Some medications, especially those that are injectable, have organic solvents, which are impossible to store in plastic bottles/containers.

The only solution to these problems has been to continue storing and transporting the drugs/medications in glass bottles. Unfortunately, the glass bottles are still considered dangerous because, when dealing with toxic drugs/medications, there is always a risk that the bottle may break. This is a major concern during transportation and during use, when a glass bottle can be dropped onto a floor and broken. In an emergency room, when time is of the essence, a broken bottle of tonic drugs could cost valuable time to clean up, which could mean the difference between life and death of a patient.

Obviously, if there were some way to continue using glass bottles for drugs/medications, but with all of the safety characteristics of plastic, it would benefit those individuals who transport the drugs/medications, medical practitioners who handle and use them, and patients who receive them.

A search of the prior art did not disclose any patents that read directly on the claims of the instant invention, however the following U.S. patents are considered related:

| U.S. PAT. NO. | INVENTOR | ISSUED |
|---|---|---|
| 5,695,090 | Burdick | Dec. 9, 1997 |
| 4,746,017 | Howard, et al | May 24, 1988 |
| 4,300,612 | Schroeder, Jr. | Nov. 17, 1981 |
| 3,982,716 | Alonzo | Sep. 28, 1976 |
| 3,604,584 | Shank, Jr. | Sep. 14, 1971 |

The U.S. Pat. No. 5,695,090 patent discloses a removable insulating container which grips a bottle such that the container is held snugly in place. The container uses a separate lower sleeve and an upper cap which are mounted on a medicine bottle to substantially encase the medicine bottle. The container is fabricated from a multi-layer flexible material which has an impact resistant outer layer and an inner layer which forms an internal channel that grips the side of the medicine bottle. The proximal end of the lower sleeve extends past the bottom of the bottle to prevent it from impacting a surface should it be dropped.

The U.S. Pat. No. 4,746,017 patent discloses a protective safety container for encasing toxic drug filled glass vials. The container includes a molded plastic body that conforms to the shape of the vial to be protected. A plurality of spaced longitudinal ribs are formed on the inner surface of the container body that act to engage the vial and hold it firmly in position. The ribs also form a cushioning air space between the vial and the container. A molded plastic annular base is snap fitted into the body so that the vial cannot be easily removed once it is secured within the container on the top of the container is a small aperture having a frangible disk that may be removed to allow a hypodermic needle to be inserted into a stopper in the vial to withdraw the vial's contents.

The U.S. Pat. No. 4,300,612 patent discloses a solvent and shatter resistant protector for glass bottles containing hazardous materials. The protector is comprised of opaque or transparent polymeric material and conforms substantially to the shape of the container that is protected. The container protector is made up of top and bottom portions, each having respective cooperating means, such as a special threading arrangement, for separable engagement, which enables engagement to be maintained even in the event of shocks that are sufficient to damage the protected glass container.

The U.S. Pat. No. 3,982,716 patent discloses a holder for temporarily supporting a bottle containing hypodermically injected medication. The holder is magnetically attached to a supporting surface, and securely supports the bottle so that both hands of the user are free to manipulate a syringe to withdraw the proper dosage from the bottle.

The U.S. Pat. No. 3,604,564 patent discloses a method for protecting glass articles such as jars and drink bottles from abrasion by heat shrinking a thermoplastic material around a portion of the glass article.

For background purposes and as indicative of the art to which the invention relates reference may be made to the remaining cited patents.

| U.S. PAT. NO. | INVENTOR | ISSUED |
|---|---|---|
| 3,967,995 | Fabianic | Jul. 6, 1976 |
| 3,578,199 | Duncan | May 11, 1971 |

DISCLOSURE OF THE INVENTION

The glass bottle protective enclosure is adapted to be used with a glass bottle which comprises a lower section having an upper shoulder and a bottle neck with an upper opening, and a bottle cap designed to be securely attached over the upper opening of the bottle neck. The glass bottle protective enclosure which is specifically designed to contain toxic injectable medication is constructed of a transparent plastic which allows the medication labels on the glass bottle to be visible through the lower container.

The glass bottle protective enclosure in its basic design is comprised of:

a) a lower bottle container having an integral side wall and a base, a bottle container cap having means for being attached to the lower bottle container, and c) means for protecting the glass bottle contained within the protective enclosure from a shock impact.

The preferred means for attaching the bottle container cap to the lower bottle container is to design the upper terminus of the lower bottle container to include a set of external threads. The cap is then designed to include a set of internal threads that are dimensioned to interface with the external threads on the lower bottle container. After the cap is attached to the lower bottle container, the enclosure with the enclosed glass bottle, is sealed by the application of a shrink wrap or the like.

The means for protecting the glass bottle contained within the protective enclosure is accomplished by having the sides and base of the lower bottle container include internal shock absorbing protrusions. The protrusions can consist of a plurality of horizontal continuous or discontinuous rings, and/or stubs that interface with the surface of the glass bottle. The lower bottle container cap can also include a set of cap shock absorbing protrusions that are positioned to interface with the bottle cap.

In view of the above disclosure it is the primary object of the invention to produce a glass bottle protective enclosure that allows medicinal glass bottles and more particularly, glass bottles that contain toxic medication, to be protected from an impact and to alert a user of the medication that the enclosure has sustained a leak.

In addition to the primary object of the invention it is also an object of the invention to produce a glass bottle protective enclosure that:

1) provides a substantial level of safety for toxic drugs, chemicals or medications by protecting glass bottles from breaking as a result of dropping or other mishandling,
2) does not substantially increase the volume of the overall package,
3) provides a sealed enclosure, therefore if the bottle should break, the liquid or powder medication therein will not leak out,
4) can be designed with a base having at least one sensor cavity into which is inserted an enclosure leakage sensor consisting of either a water soluble sensor or an electronic sensor. Either sensor will alert a user of a leakage by means of a visible or audible signal respectively,
5) can be used to contain any drug/medication that is normally contained within a glass or plastic bottle,
6) can be used to protect various type and sizes of bottles and bottle caps including flip caps,
7) can be made in various colors to indicate the contents within the bottle,
8) allows labels or other indicia that is on a bottle to be visible.
9) can be easily manipulated during use,
10) provides a greater amount of comfort for transporters, medical practitioners and patients,
11) provides a means of safe transporting and storage, and
12) is cost effective from both a manufacturer's and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 7:
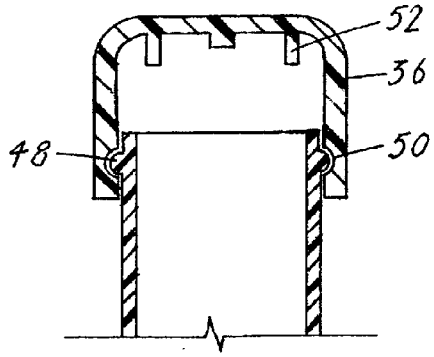
FIG. 7 is a partial cross-sectional elevational view showing a lower bottle-container cap attached to a lower bottle container by means of complimentary detents.
Figure 8:
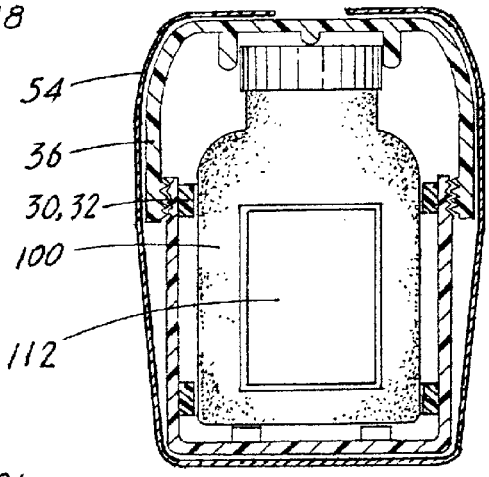
FIG. 8 is a cross-sectional elevational view of a glass bottle protective enclosure which is covered by a shrink wrap to add a further degree of safety.
Figure 9:
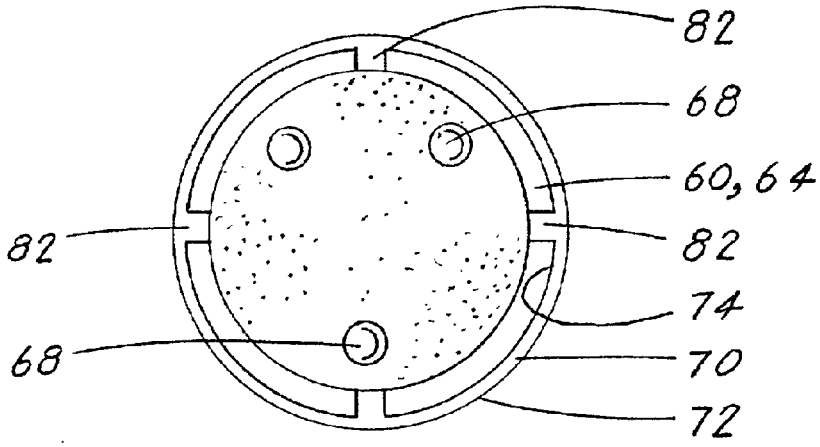
FIG. 9 is a plan view of a glass bottle protective enclosure consisting of a skeletal structure.
Figure 10:
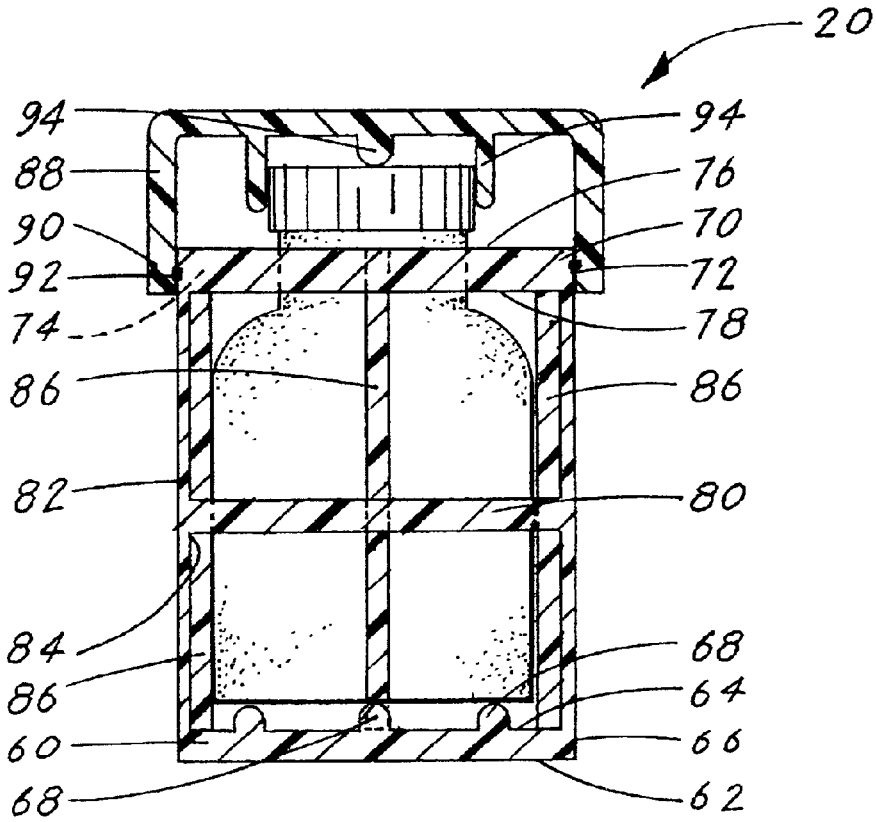
FIG. 10 is a cross-sectional elevational view of a glass bottle protective enclosure consisting of a skeletal structure.

The best mode for carrying out the invention is presented in terms of a first embodiment, as shown in FIGS. 1–8, and a second embodiment as shown in FIGS. 9 and 10. The first and second embodiments both disclose a glass bottle protective enclosure 10 (hereinafter "GBPE 10") which provides safe use, handling and transportation of glass bottles and their contents.

The first embodiment of the GBPE 10 is comprised of the following major elements: a lower bottle container 12 having a base 14, an integral side wall 22, a set of shock absorbing protrusions 30, and a bottle container cap 36. The GBPE 10 is designed to enclose and protect a glass bottle 100, which typically consists of a lower section 102 having an upper shoulder 104 and a bottle neck 106 with an upper opening 108, and a bottle cap 110 that is designed to be securely attached over the upper opening 67 of the bottle neck 66. Additionally, many applications require a label 112 to be placed on the bottle 100 to indicate the contents therein, application instructions, warning messages and the like, one such application is for medical use and particularly when the glass bottle 100 is specifically designed to contain toxic injectable medication, such as Cis-platin, and carboplatin which is a drug/medication used in ontology.

Figure 1:
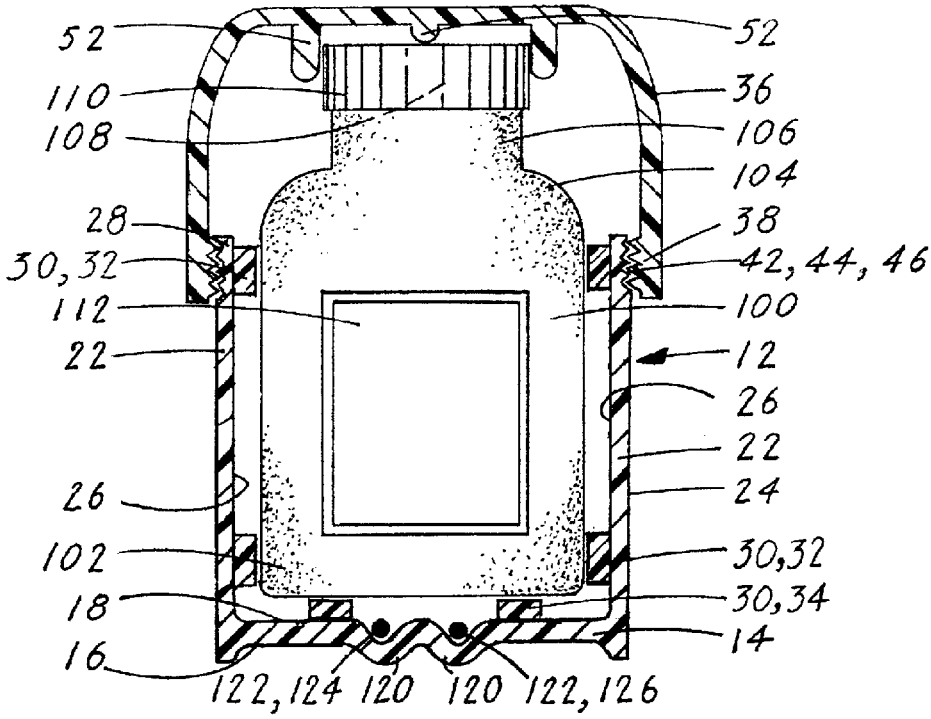
FIG. 1 is cross-sectional elevational view of a glass bottle enclosed within a glass bottle protective enclosure having a pair of shock absorbing protrusions configured as shock absorbing rings and a base which includes a pair of sensor cavities enclosing a leakage sensor.

As shown in FIG. 1, the lower bottle container 12 is comprised of the base 14, which has a lower surface 16 and an upper surface 18, and the integral side wall 22. The base 14 can be designed with a flat upper surface 18 as shown in FIGS. 5, 6, 8 and 10 or can be designed to include at least one sensor cavity 120 and preferably a pair of cavities 120, as shown in FIG. 1, that extend inward from the upper surface 18. Into the cavities 120 are inserted and captively held an enclosure leakage sensor 122 which can consist of a water soluble substance 124 or an electronic sensor 126.

The water soluble substance, which can consist of a dye tablet or a capsule, produces a visable color when the substance is dissolved into the leaked liquid medication from the bottle 100 protected by the enclosure 10. The tablet or capsule are selected to be stable in air and to not generate any secondary volatile hazardous material when exposed to the leaked liquid medication.

The electronic sensor 126 is designed to produce an audible signal when the sensor 126 is exposed to the leaked liquid medication contained in the bottle 100 protected by the enclosure 10. In either type of sensor the function of the sensor is to alert a user of a liquid medication that a leakage has occurred.

The integral side wall 22, as also shown in FIG. 1, extends upward from the base 14 and has an outer surface 24, an inner surface 26 and an upper terminus 28 that terminates adjacent the shoulder 104 of the glass bottle 100. As also shown in FIG. 1, the lower bottle container 12 is constructed of a transparent plastic such as polycarbonate, which allows the label 112 on the bottle 100 to be visible through the container 12.

The shock absorbing protrusions 30, as shown in FIGS. 1–6, can be configured in several designs. Typically, the protrusions 30 project outward from the upper surface 18 of the base 14, and/or from the inner surface 26 of the side wall 22.

Figure 5:
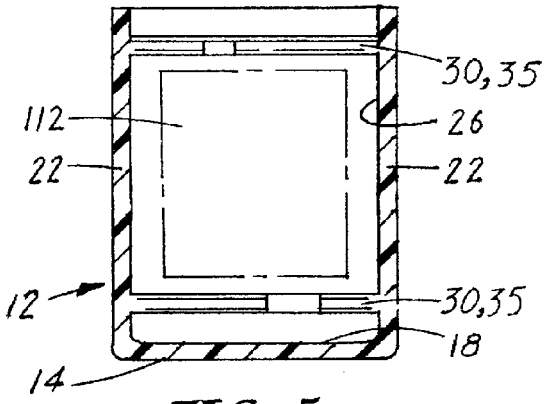
FIG. 5 is a cross-sectional elevational view of a glass bottle enclosure having shock absorbing protrusions configured as discontinuous rings.

The first design configuration, as shown in FIG. 1, comprises a pair of outward projecting shock absorbing protrusions 30 consisting of a pair of shock absorbing rings 32. The first ring 32 is located adjacent the base 14 of the lower bottle container 12 and the second ring 32 is located adjacent the container's upper terminus 28. By this ring placement, the label 112 on the glass bottle 100 is not obstructed and thus, clearly visible. As shown in FIG. 5, the rings 32 can also be configured as discontinuous rings.

Figure 2:
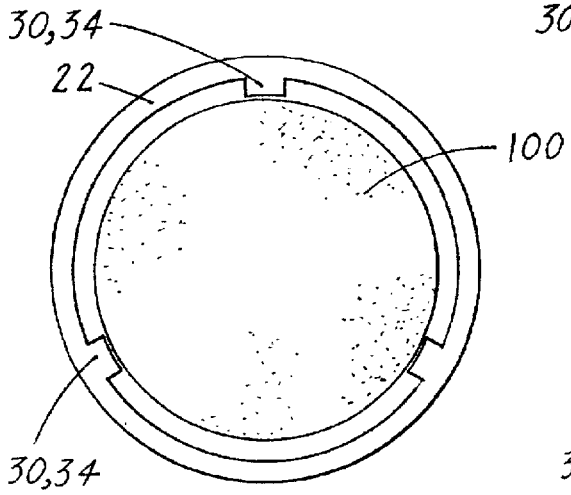
FIG. 2 is a plan view showing a bottle supported by shock absorbing protrusions configured as shock absorbing stubs having a flat outer surface and spaced at 120° intervals.
Figure 3:
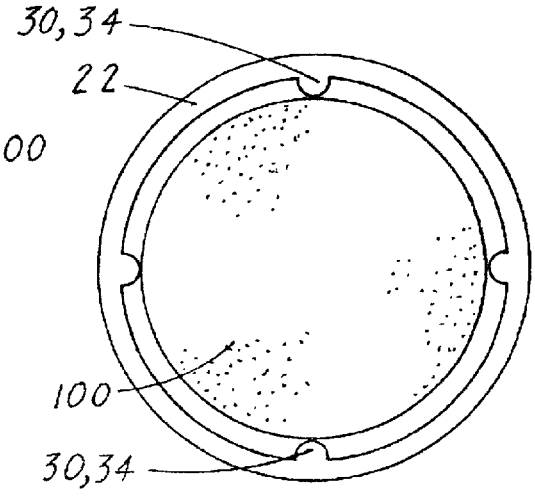
FIG. 3 is a plan view showing a bottle supported by four shock absorbing protrusions configured as shock absorbing stubs having a radiused outer surface and spaced equidistant.
Figure 4:
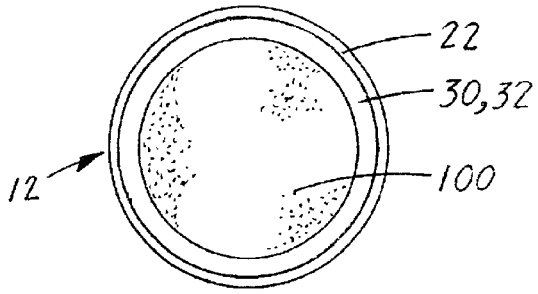
FIG. 4 is a plan view showing a glass bottle supported by a glass bottle protective enclosure having shock absorbing protrusions configured as shock absorbing rings.

The second design configuration, as shown in FIGS. 2 and 3, utilizes shock absorbing protrusions 30 consisting of a plurality of shock absorbing stubs 34 that project outward from the inner surface 26 of the integral side wall 22. When three stubs 34 are used, they are typically spaced at 120° intervals, as shown in FIG. 2; if four stubs are used, they are typically spaced at 0°, 90°, 180° and 270°, as shown in FIG. 3.

Figure 6:
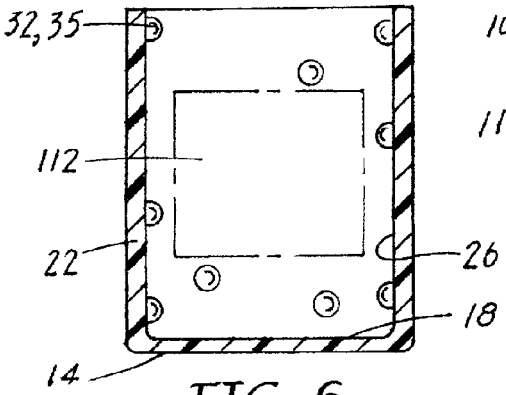
FIG. 6 is a cross-sectional elevational view showing a glass bottle enclosure having a plurality of shock absorbing stubs.

The third design configuration, as shown in FIG. 6, utilizes shock absorbing protrusions 30 consisting of randomly placed stubs 34, which project outward from the inner surface 26 of the side wall 22 and the upper surface 18 of the base 14.

Note that in all of the glass bottle protective enclosure 10 designs, the shock absorbing protrusions 30 are omitted from the area which includes the label 112.

The bottle container cap 36, as shown in FIG. 1, is comprised of a lower terminus 38, which has means 42 for being securely attached to the upper terminus 28 of the side wall 22. As shown in FIG. 1 the means 42 for securely attaching the lower bottle container cap 36 to the side wall 22 is accomplished by having the upper terminus 28 of the side wall 22 include a set of external threads 44. The lower terminus 38 of the cap 36 likewise has a set of internal threads 46 which are dimensioned to interface with the external threads 44 on the side wall 22, as shown in FIG. 1. The lower bottle container 12 and the bottle container cap 36 are both constructed of a plastic selected to provide complimentary threads 44,46 that allow a tight, leak-proof seal. Therefore, if the enclosed glass bottle should accidentally break, the contents of the bottle, whether it be a liquid, a solution or a powder, will remain inside the confines of the glass bottle protective enclosure 10. Thus, preventing any toxic substance from escaping into the environment.

A second means of attaching the lower bottle container cap 36 to the integral side wall 22 is accomplished by having the upper terminus 28 of the side wall 22 includes a male detent 48. The male detent is dimensioned to accept a tight-fitting female detent 50, which is located on the lower container cap 36, as shown in FIG. 7.

To complete the protective elements of the GBPE 10, a set of cap shock absorbing protrusions 52, are utilized. The cap shock absorbing protrusions 52 are positioned to interface with the bottle cap 69, as shown in FIG. 1, and may consist of any of the type of design configurations previously described for the lower bottle container 12. Additionally, to add to the utility and effectiveness of the GBPE 10, any combination of design configurations of the shock absorbing protrusions 30 and 52 may be utilized in either or both of the lower bottle container 12 and/or lower bottle container cap 36.

In order to assist in identifying the contents of a glass bottle 60 located within the GBPE 10, the lower bottle container 12 and/or lower bottle container cap 36 can be color-coded. Finally, as shown in FIG. 8, shrink wrap 54 may encompass the lower container 12 and the cap 36 to add a further degree of safety.

The second embodiment, as shown in FIGS. 9 and 10, are configured as a skeletal structure 20 and is comprised of the following major elements: a base 60, an upper ring 70, an intermediate ring 80, a shock absorbing rib 86 and a lower bottle-container cap 88.

The base 60 includes a lower surface 62, an upper surface 64, an outer edge 66 and a plurality of shock absorbing protrusions 68 which project upward from the upper surface 64 of the base 60 as shown in FIGS. 9 and 10.

The upper ring 70 includes an outer surface 72, an inner surface 74, an upper edge 76 and a lower edge 75. The intermediate ring 80, which adds structural integrity to the skeletal structure 20 includes an outer surface 82 and an inner surface 84.

The skeletal structure 20 employs at least three shock absorbing ribs 86. Each rib 86 extends integrally upward from the outer edge 66 of the base 60 and each rib is integrally attached to the outer surfaces of the upper and intermediate rings 70, 80.

To complete the second embodiment of the GBPE 10 the lower bottle container cap 88 is employed. The cap 88 includes a lower terminus 90 having means 92 for being securely attached to the outer surface 72 of the upper ring 70. The cap 88 includes a set of shock absorbing protrusions 94 which are positioned to interface with the bottle cap 110 as shown in FIG. 10.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

What is claimed is:

1. A glass bottle protective enclosure adapted for use with a glass bottle comprising a lower section having a shoulder and a bottle neck with an upper opening, and a bottle cap designed to be securely attached over the upper opening of the bottle neck, said glass bottle protective enclosure comprising:

a) a lower bottle container having an integral side wall and a base, b) a lower bottle-container cap having means for being attached to said lower bottle container, c) means for protecting a glass bottle specifically designed to contain toxic injectable medication, contained within said protective enclosure from a shock impact, and d) a base having at least one sensor cavity into which is inserted an enclosure leakage sensor.

2. The glass bottle protective enclosure as specified in claim 1 wherein said lower container is constructed of a transparent plastic which allows medication labels on a glass bottle to be visible through the lower container and wherein said bottle container cap is also constructed of plastic.

3. The glass bottle protective enclosure as specified in claim 1 wherein said means for attaching said bottle container cap to said lower bottle container comprises:

a) an upper terminus of said integral side wall having a set of external threads, and b) a lower terminus of said cap having a set of internal threads dimensioned to interface with the external threads on said integral side wall, wherein when the two threads are threaded, a tight leak-proof seal is provided.

4. The glass bottle protective enclosure as specified in claim 1 wherein said means for protecting a glass bottle contained within said protective bottle guard comprises:

a) said lower bottle container having a plurality of internal shook absorbing protrusions that interface with the surface of a glass bottle, and b) said bottle container cap having a set of cap shook absorbing protrusions positioned to interface with a glass bottle cap.

5. The glass bottle protective enclosure as specified in claim 4 wherein said plurality of internal shock absorbing protrusions are comprised of rings or stubs.

6. The glass bottle protective enclosure as specified in claim 5 wherein said plurality of shook absorbing protrusions are located to not obstruct the view of a label attached to a glass bottle.

7. The glass bottle protective enclosure as specified in claim 1 wherein said lower bottle container is constructed of a color-tinted plastic to indicate the type of medication contained in a glass bottle.

8. The glass bottle protective enclosure as specified in claim 1 wherein said enclosure leakage sensor is comprised of a water soluble substance that produces a visible color when the substance is dissolved into a leakage of the liquid medication contained in a bottle protected by said enclosure.

9. The glass bottle protective enclosure as specified in claim 1 wherein said enclosure leakage sensor is comprised of an electronic sensor that produce an audible signal when the sensor is exposed to a leakage of the liquid medication contained in a bottle protected by said enclosure.

10. A glass bottle protective enclosure adapted for use with a glass bottle comprising a lower section having a shoulder and a bottle neck with an upper opening, and a bottle cap designed to be securely attached over an upper opening of a glass bottle neck, said glass bottle protective enclosure comprising:

a) a lower bottle container having:

(1) a base with a lower surface and an upper surface, (2) an integral side wall extending upward from said base and having an outer surface, an inner surface and an upper terminus that terminates adjacent a shoulder of a glass bottle, b) a plurality of shock absorbing protrusions projecting outward from the upper surface of said base and from the inner surface of said side wall, c) a bottle container cap having:

(1) a lower terminus having means for being securely attached to the upper terminus of said side wall, and (2) a set of shock absorbing protrusions positioned to interface with a glass bottle cap, and d) a base having at least one sensor cavity into which is inserted an enclosure leakage sensor.

11. The glass bottle protective enclosure as specified in claim 10 wherein said enclosure leakage sensor is comprised of a water soluble substance that produces a visible color when the substance is dissolved into a leakage of liquid medication contained in a bottle protected by said enclosure.

12. The glass bottle protective enclosure as specified in claim 10 wherein said enclosure leakage sensor is comprised of an electronic sensor that produce an audible signal when the sensor is exposed to a leakage of the liquid medication contained in a glass bottle protected by said enclosure.

13. The glass bottle protective enclosure as specified in claim 10 wherein enclosure is specifically designed to protect a glass bottle containing toxic injectable medication.

14. The glass bottle protective enclosure as specified in claim 13 wherein said lower container is constructed of a transparent plastic which allows a medication label on a glass bottle to be visible through the lower container, and wherein said bottle container cap is also constructed of plastic.

15. The glass bottle protective enclosure as specified in claim 14 wherein said transparent plastic is comprised of polycarbonate.

16. The glass bottle protective enclosure as specified in claim 13 wherein said plurality of shock absorbing protrusions projecting outward from the inner surface of said side wall are comprised of a pair of rings located adjacent the base and the upper terminus of said lower bottle container.

17. The glass bottle protective enclosure as specified in claim 16 wherein said plurality of shock absorbing protrusions are configured as discontinuous rings.

18. The glass bottle protective enclosure as specified in claim 13 wherein said plurality of shock absorbing protrusions are comprised of randomly placed stubs that project outward from the inner surface of the side wall and the upper surface of the base.

19. The glass bottle protective enclosure as specified in claim 13 wherein said means for securely attaching said lower bottle container cap to said side wall comprises:

a) the upper terminus of said integral side wall having a set of external threads, and b) the lower terminus of said cap having a set of internal threads dimensioned to interface with the external threads on said integral side wall, wherein when the two threads are threaded, a tight leak-proof seal is provided.

20. The glass bottle protective enclosure as specified in claim 13 wherein said means for securely attaching said lower container cap to said side wall comprises the upper terminus of said integral side wall having a male detent that accepts a tight-fitting female detent on said lower container cap.

21. The glass bottle protective enclosure as specified in claim 13 wherein said lower bottle container and/or said lower bottle container cap are colored/coded to indicate type of medication.

22. The glass bottle protective enclosure as specified in claim 13 further comprising a shrink wrap that encompasses said lower container and said lower bottle container cap.

* * * * *